US009123982B2

(12) United States Patent
Ye et al.

(10) Patent No.: US 9,123,982 B2
(45) Date of Patent: Sep. 1, 2015

(54) DIRECTIONAL COUPLER INTEGRATED BY CMOS PROCESS

(75) Inventors: Le Ye, Beijing (CN); Jiayi Wang, Beijing (CN); Huailin Liao, Beijing (CN); Ru Huang, Beijing (CN)

(73) Assignee: Peking University, Beijing (CN)

( * ) Notice: Subject to any disclaimer, the term of this patent is extended or adjusted under 35 U.S.C. 154(b) by 289 days.

(21) Appl. No.: 13/641,647

(22) PCT Filed: Apr. 16, 2012

(86) PCT No.: PCT/CN2012/074063

§ 371 (c)(1),
(2), (4) Date: Oct. 16, 2012

(87) PCT Pub. No.: WO2013/082911

PCT Pub. Date: Jun. 13, 2013

(65) Prior Publication Data

US 2013/0141183 A1 Jun. 6, 2013

(30) Foreign Application Priority Data

Dec. 5, 2011 (CN) ..... 2011 1 0399962

(51) Int. Cl.
*H01P 5/18* (2006.01)

(52) U.S. Cl.
CPC ..... *H01P 5/184* (2013.01); *H01P 5/187* (2013.01)

(58) Field of Classification Search
CPC ..... H01P 5/18; H01P 5/184; H01P 5/187
USPC ..... 333/109, 111, 112
See application file for complete search history.

(56) References Cited

U.S. PATENT DOCUMENTS 7,190,188 B2 3/2007 Otsuka (Continued)

FOREIGN PATENT DOCUMENTS

CN 1617120 5/2005
EP 2387097 11/2011

OTHER PUBLICATIONS

Shim et al, "A CMOS Power Amplifier With Integrated-Passive-Device Spiral-Shaped Directional Coupler for Mobile UHF RFID Reader", 2011, IEEE, Transactions on Microwave Theory and Techniques, vol. 59, No. 11, p. 2888-2897.*
International Search Report issued in PCT/CN2012/074063 on Aug. 30, 2012.

(Continued)

*Primary Examiner* — Benny Lee
*Assistant Examiner* — Albens Dieujuste
(74) *Attorney, Agent, or Firm* — DLA Piper LLP (US)

(57) ABSTRACT

A directional coupler is disclosed integrated on a single chip and an integrated circuit based on a standard CMOS process and relates to a field of radio frequency communication. In exemplary implementations, by using a standard CMOS process technology, the directional coupler integrated by a CMOS process is formed by a coil wound by a upper layer of metal lines, a coil wound by a lower layer of metal lines, two tuning capacitor array, and a matching resistor. Two terminals of the coil are a direct terminal and an input terminal; two terminals of the coil are a coupled terminal and an isolation terminal; the terminals of the coils and are intersected at 90°; the coil is wound by an upper metal layer and the coil is wound by a lower metal layer. Further, the insertion loss is low and the isolation degree is large.

20 Claims, 5 Drawing Sheets

(56) References Cited

U.S. PATENT DOCUMENTS

| | | | |
|---|---|---|---|
| 7,863,998 | B2 | 1/2011 | Rofougaran |
| 8,228,134 | B2 | 7/2012 | Rofougaran |
| 2005/0040846 | A1 | 2/2005 | Otsuka |
| 2009/0212887 | A1 | 8/2009 | Rofougaran |
| 2011/0095842 | A1 | 4/2011 | Rofougaran |

OTHER PUBLICATIONS

English Language Abstract of CN 1617120 published May 18, 2005.

Chinese Office Action dated Jul. 16, 2014, in Chinese patent application No. 201110399962.5 (5 pages). [References cited herein are from the ISR and were previously submitted Jun. 19, 2013].

* cited by examiner

Notes :

W - Metal Line Width; S - Metal Line Interval; D1 - Minimum Inner Radius; D2 - Maximum Outer Radius; H - Interval Between Upper and Lower Metal Layers; O - Overlap Length of Upper and Lower Metal Layers

DIRECTIONAL COUPLER INTEGRATED BY CMOS PROCESS

CROSS REFERENCE TO RELATED APPLICATIONS

This application is a U.S. National Stage Application of International Application No. PCT/CN2012/074063 filed Apr. 16, 2012. International Application No. PCT/CN2012/074063 claims priority from Chinese Patent Application No. 201110399962.5 filed Dec. 5, 2011. The entirety of all of the above-listed Applications are incorporated herein by reference.

FIELD OF THE INVENTION

The present invention relates to the field of a radio frequency integrated circuit technology, and particularly relates to a on-chip integration directional coupler and an integrated circuit by using a standard CMOS process.

BACKGROUND OF THE INVENTION

A directional coupler is a radio frequency device widely used for a signal isolation, a signal separation, etc., and is used to make a radio frequency receiver and a radio frequency transmitter operate at the same frequency band. FIG. 1 illustrates a principle of a directional coupler used in a transceiver system, an input terminal (Input) is connected to an output terminal of a transmitter (TX), and a direct terminal (Direct) is connected to an antenna (Antenna), a coupled terminal (Coupled) is connected to an input terminal of a receiver (RX), an isolated terminal (Isolated) is connected to a matching resistor (Res). There are some definitions for the directional coupler. A loss from the input terminal to the direct terminal is referred as an insertion loss (Insertion Loss), a loss from the input terminal to the coupled terminal is referred as a coupling degree (Coupling), a loss from the direct terminal to the coupled terminal is referred as an isolation degree (Isolation), a difference between the isolation degree to the coupling degree is referred as directivity (Directivity). It is required that the insert loss is very low, the coupling degree is not very large, and the isolation degree is very large, that is, the directivity is strong. For a transceiver system with the same frequency for receiving and transmitting, the energy for transmitting a signal is generally large and a large portion thereof may be coupled to the input terminal of the receiver, however, a receiving signal is very weak and a very strong output coupling signal may affect the useful receiving signal if a directional coupler is not used, which may cause the receiver not to operate properly, as shown in the left part of FIG. 2. After the directional coupler is used, the receiving signal may be partially lost due to the coupling degree, and meanwhile the transmitting signal coupled to the input terminal is greatly attenuated. Thus, the transceiver with the same frequency for receiving and transmitting may operate properly, as shown in the right part of FIG. 2.

Generally, a conventional directional coupler is fabricated by using a transmission line, as described in a reference (Hilal Ezzeddine et al., "Directional coupler", U.S. patent, U.S. Pat. No. 7,394,333 B2, Jul. 1, 2008). The conventional directional couplers have a large volume, complicated assembling processes and high costs. Then, in order to miniaturize the directional coupler, separated components are used, as described in a reference (Oleksandr Gorbachov, "Directional coupler for RF power detection", U.S. patent, U.S. Pat. No. 7,576,626 B2, Aug. 18, 2009). However, such a directional coupler is still unable to be integrated. With the rapid development of the integrated circuit, the on-chip integration is a tendency of the future. An integrated directional coupler expands the applicability and has a lower cost, and is applied for, for example, a radio frequency identification (RFID Reader) and so on. In order to implement an on-chip integration for the directional coupler, some special processes are employed, as shown in a reference (Shim, S., Hong, S., "A CMOS Power Amplifier With Integrated-Passive-Device Spiral-Shaped Directional Coupler for Mobile UHF RFID Reader," Microwave Theory and Techniques, IEEE Transactions on , vol. PP, no. 99, pp. 1, 0). The reference describes a directional coupler fabricated by using an integrated passive device (IPD) process. Though the directional coupler has a small volume, a special processing technology that can not be compatible with a standard CMOS process is used, the cost is high, and a complicated process is used. Thus, it is difficult to achieve an over-chip integration for the directional coupler, and the practical applicability of the directional coupler is limited.

At present, the solution or technology for implementing the directional coupler as described in the known references and patents do not implement the directional coupler by using a standard CMOS process, which greatly limits the application range thereof. For example, in the field of the mobile communication system, miniaturization and portability are highly required. Though some directional couplers have met the requirement of miniaturization, the usage of special process causes a high cost and it is hardly to meet the requirements of the system integration.

SUMMARY OF THE INVENTION

Therefore, it is an object of the present invention to provide a directional coupler integration technology and an integrated circuit based on a standard CMOS process. The technology has a feature that the on-chip integration can be achieved by using a standard silicon-based CMOS process, and has a small area, a low input loss, a high coupling degree, a high isolation degree and a strong tuning ability.

The above object of the present invention is achieved by the following technical solution.

A directional coupler integration technology and integrated circuit based on a standard CMOS process are provided as follows (as shown in FIGS. 3 and 4).

(1) A coil 1 is provided between an input terminal (Input) and a direct terminal (Direct) and is wound by a Mth metal layer, and an intersect portion thereof is connected by (M−1) th metal layer; a coil 2 is provided between an input terminal (Input) and an isolated terminal (Isolated) and is wound by an Nth metal layer, and an intersect portion thereof is connected by (N+1) the metal layer, wherein $N \geq 1$, $M \geq N+2$. Thus, a three-dimensional structure is formed.

(2) The coils 1 and 2 are wound in a shape of a square shape, a circle shape, a rectangle shape, an octagon shape or other polygon shape.

(3) The two ends of the coil 1 and the two ends of the coil 2 form an angle of 90°, the distance between the direct terminal (Direct) and the coupled terminal (Coupled) is small, while the distance between the input terminal (Input) and the coupled terminal (Isolated) is large.

(4) Metal coils of the coil 1 and the coil 2 are intersectly arranged, a center of an upper/lower metal line (center of metal) is aligned with a center of a lower/upper metal line, interval (center of interval), the upper and lower metal lines have an excessive overlap O (also may have no excessive overlap), that is, the line width W of the metal line may be larger than or equal to or smaller than the interval S between the metal lines.

(5) An adjustable capacitor array Cp is disposed between the input terminal and the direct terminal to achieve a frequency tuning.

(6) An adjustable capacitor array Cs is disposed between the coupled terminal and the isolated terminal to achieve an isolation degree tuning.

The principle of the present invention is described as follow.

(a) A directional coupler is equivalent to a passive transformer with a changed structure. For a general passive transformer, four terminal parameters are symmetrical. However, the directional coupler uses the asymmetry of space and position to effect the differences among the four terminal parameters. Two terminals of coil 1 (in this disclosure, the coil 1 may be square, rectangle, circle, octagon or other polygon) wound by a Mth metal layer and two terminals of coil 2 (in this disclosure, the coil 2 may be square, rectangle, circle, octagon or other polygon) winded by a Nth metal layer are perpendicular at 90°. By using the space asymmetry, the four terminal circuit parameters are different and show a directionality. The direct terminal (Direct) and the input terminal (Input) are two terminals of an identical layer of coil. The coupled terminal (Coupled) and the isolated terminal (Isolated) are two terminals of another identical layer of coil. The distance between the direct terminal (Direct) and the coupled terminal (Coupled) is small and the distance between the input terminal (input) and the isolation terminal (Isolated) is larger.

(b) The coils 1 and 2 have different shapes, radiuses (minimum inner radius is D1 and maximum outer radius is D2) and coil numbers. The coils 1 and 2 may use metal lines with different line widths W and different intervals S. The insertion loss (Insertion Loss), coupling degree (Coupling), isolation degree (Isolation) and directivity (Directivity), etc. may be adjusted by changing the metal line at different layers (or by changing the vertical interval between the upper metal line and the lower metal line).

(c) Generally, the directional coupler is designed so that the outputs of power amplifiers are well matched. However, in practice, the outputs of the transmitter power amplifier are poorly matched and variations of output power may lead to variation of the match of the power amplifier, so that there is a deviation between the practical performance and the design value of the directional coupler. In additional to the above problems, the factors such as process fluctuation and temperature variation and the like may cause deterioration of performance of the directional coupler.

The directional coupler uses a capacitor Cp for a frequency tuning and a capacitor Cs for an isolation degree tuning to address the above problems.

The present invention has the following advantages.

(1) The input loss is low. The input terminal (Input) and the direct terminal (Direct) are connected by a Mth metal layer (at the crossing connected by (M−1)th metal layer), an upper metal layer (with respect to a metal layer used by another layer of coil) has a small parasitic capacitance with respect to the ground, and the matching resistor of an isolation terminal of a lower layer of coil are grounded, a portion of a parasitic capacitance of the upper layer of coil is shielded by the lower layer of coil, so that the input loss is very small.

(2) The directivity is good. The present invention uses a stereochemical coil structure which includes a coil 1 formed by a Mth metal layer and a coil 2 formed by an Nth metal layer (N≥1, M≥N+2), and a vertical distance H is larger. The upper and lower metal layer are intersectly arranged in a vertical direction, line width centers of upper/lower metal layer and interval centers of lower/upper metal lines are aligned with each other in the vertical direction. There is an excessive overlap (also may have no excessive overlap) at the edge of the metal layer. Those features mentioned above make the isolation degree greatly increase, the directivity become better, as shown in FIG. 5 (a simulation result at the operation frequency of the transceiver is 875 MHz). FIG. 5 shows a simulation result of an actual directional coupler. In FIG.5, the horizontal axis represents frequency in unit of GHz, and the vertical axis represents gain in unit of dB. Wherein, when the frequency during operation is 875.22 MHz, the isolation is −60.19 dB and the coupling is −12.16 dB. M0 and M1 respectively represent two points on the coupling curve, M0 in the present example represents that the isolation is −30.34 dB at the frequency of 758.3 MHz; M1 in the present example represents that isolation is −30.8 dB at the frequency of 957.5 MHz.

(3) The area is small. Since the stereochemical coil structure is used and the upper and lower metal layer are intersectly arranged, in the case of the same identical directivity requirement, the interval between the metal lines may be smaller, the whole structure of the directional coupler may be more compact and area thereof may be smaller, as compared with a flat coil structure.

(4) The applicability range is wide. During the design process, by changing the shapes (e.g. square, rectangle, circle, polygons such as octagon), coil numbers, radiuses (minimum inner radius D1, maximum outer radius D2) of the coils 1 and 2, the interval between the metal layers used by coils 1 and 2 (e.g. selecting the metal at different layers as the lower or upper layer to change the vertical interval H between the upper and lower layer of metal coil), and the depth O excessively overlapped between two coils, the magnitudes of insertion loss, coupling degree, isolation degree and directivity may be flexibly changed. Also, the above factors may be changed to meet with different requirements of different systems.

(5) The tuning ability is good. A capacitor Cp is introduced for a frequency tuning and a capacitor Cs is introduced for an isolation degree tuning. As such, the actual operation of the device may be prevented from deteriorating due to the non-ideal effects resulted from a poor matching between the outputs of the transmitters (TX), and a varied output matching under different output powers, a process fluctuation and a temperature variation.

(6) The device of the present invention may be integrated into a single chip with the standard silicon-based CMOS process and may also be integrated with a BiCMOS process, a HBT process and so on. The device may be used as a module to be integrated with other circuits and systems over a single chip. Thus, a cost is reduced, and system integration degree may be greatly increased.

BRIEF DESCRIPTION OF THE DRAWINGS

The present invention will be described in more detail below in conjunction with the attached drawings.

DETAILED DESCRIPTION OF THE EMBODIMENTS

For the purpose of detailed illustration of the present invention, a specified embodiment is described below.

A directional coupler integrated by a CMOS process of the present invention may be connected to a transmitter, a receiver, an antenna and a matching resistor to form a transceiver which operates at the same frequency simultaneously. As a radio frequency identification reader achieved by the present invention shown in FIG. 6, the receiver and the transmitter may be simultaneously operated at the same frequency.

Figure 1:
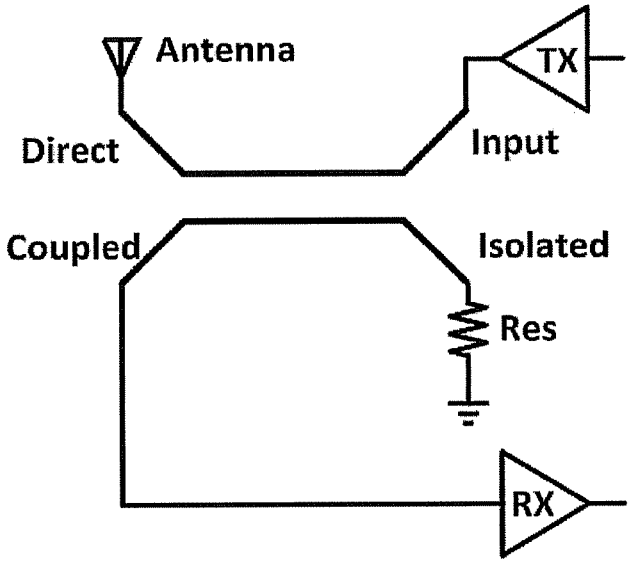
FIG. 1 is a principle diagram of a directional coupler used in a general transceiver system.
Figure 2:
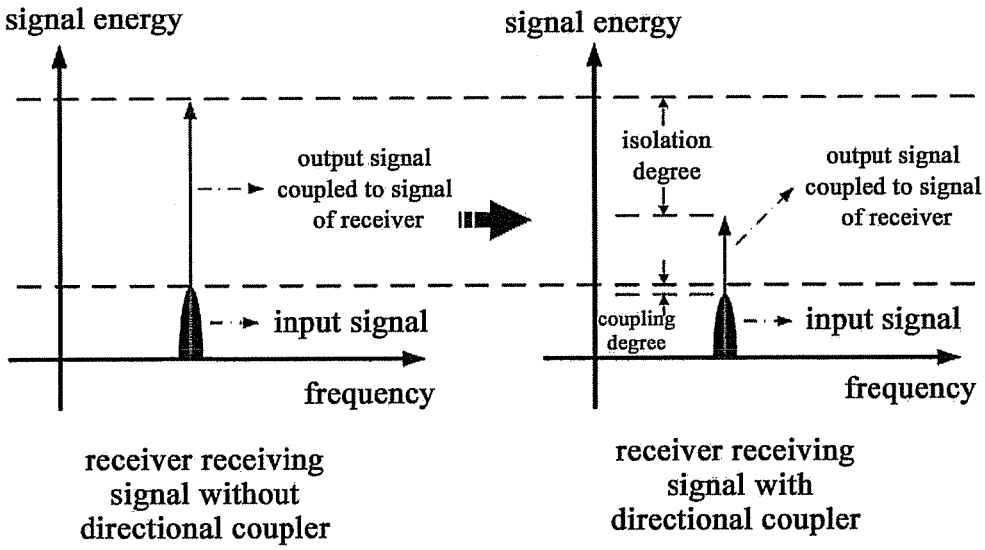
FIG. 2 is a principle diagram of a directional coupler for restraining the coupling portion of a transmitting signal in a receiving signal.
Figure 3:
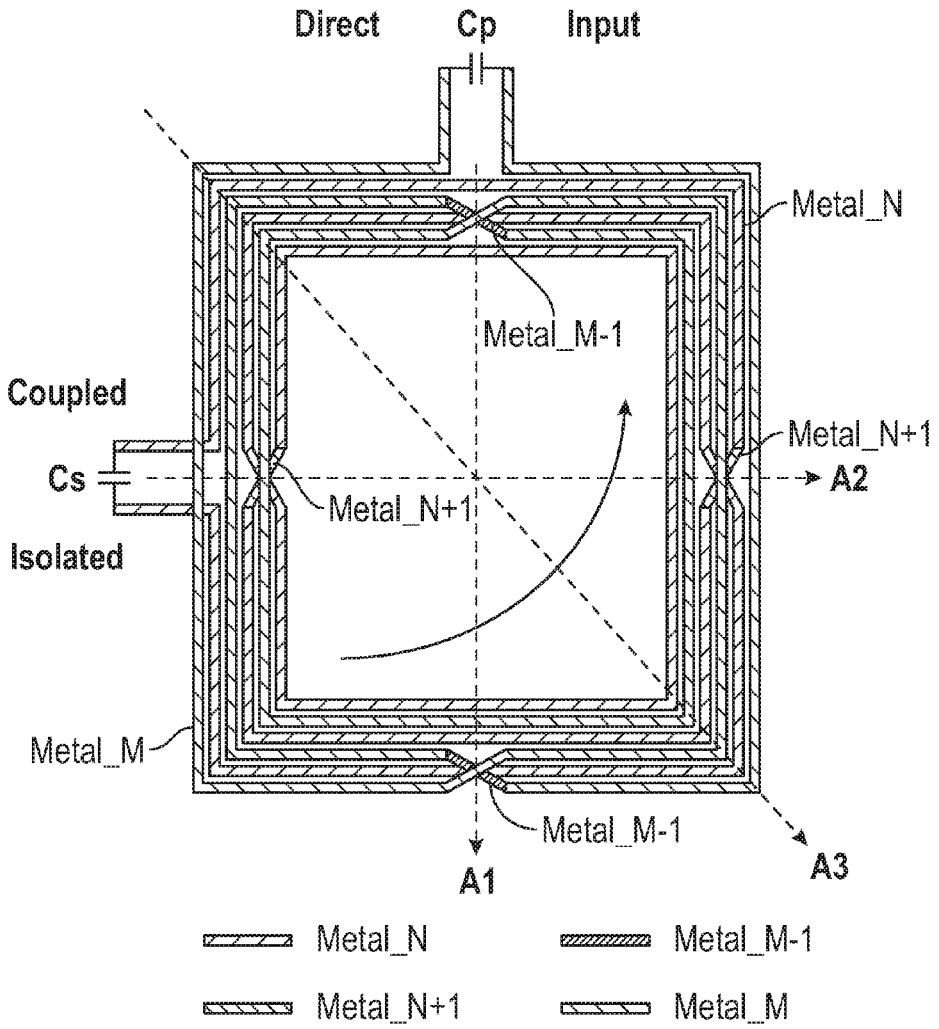
FIG. 3 is a plan view showing a layout of a novel directional coupler based on a standard CMOS process of the present invention.
Figure 4:
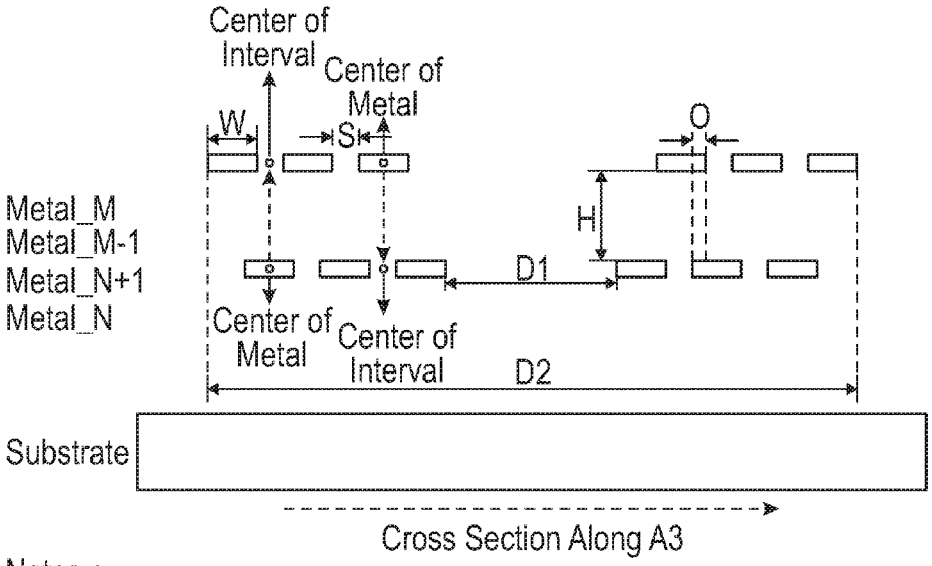
FIG. 4 is a cross sectional view taken along a line A3 of the layout of the novel directional coupler based on a standard CMOS process of the present invention.
Figure 5:
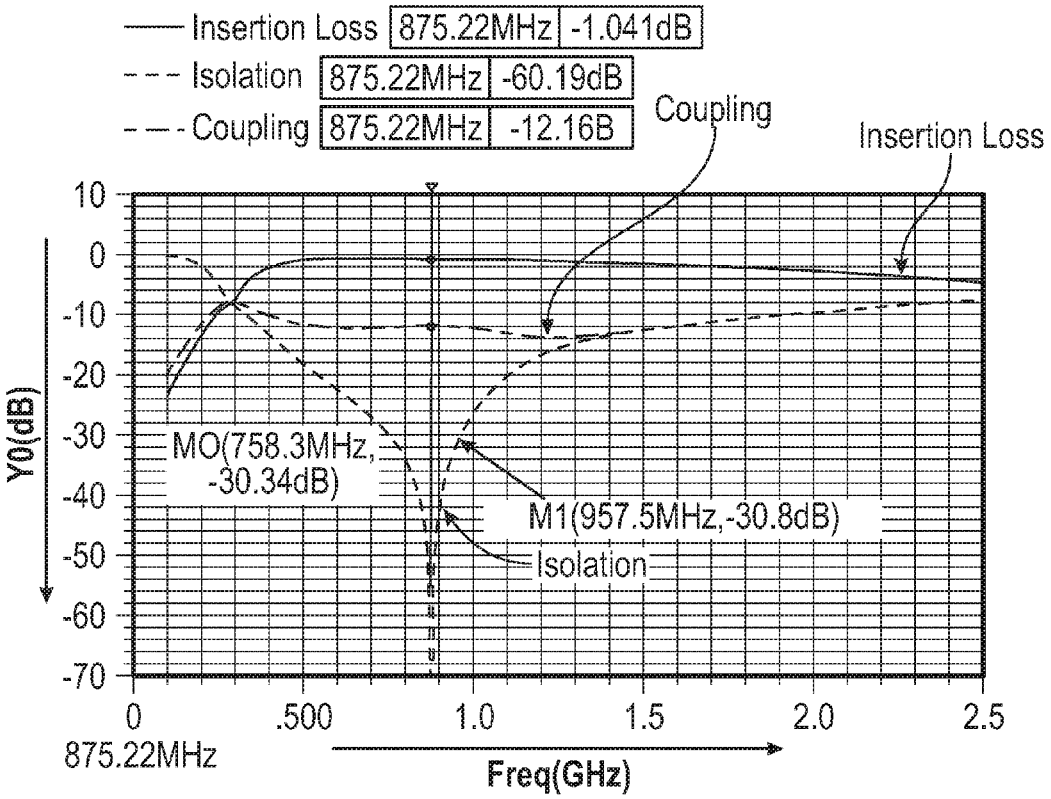
FIG. 5 is a graph showing the performance of the novel directional coupler based on a standard CMOS process of the present invention.
Figure 6:
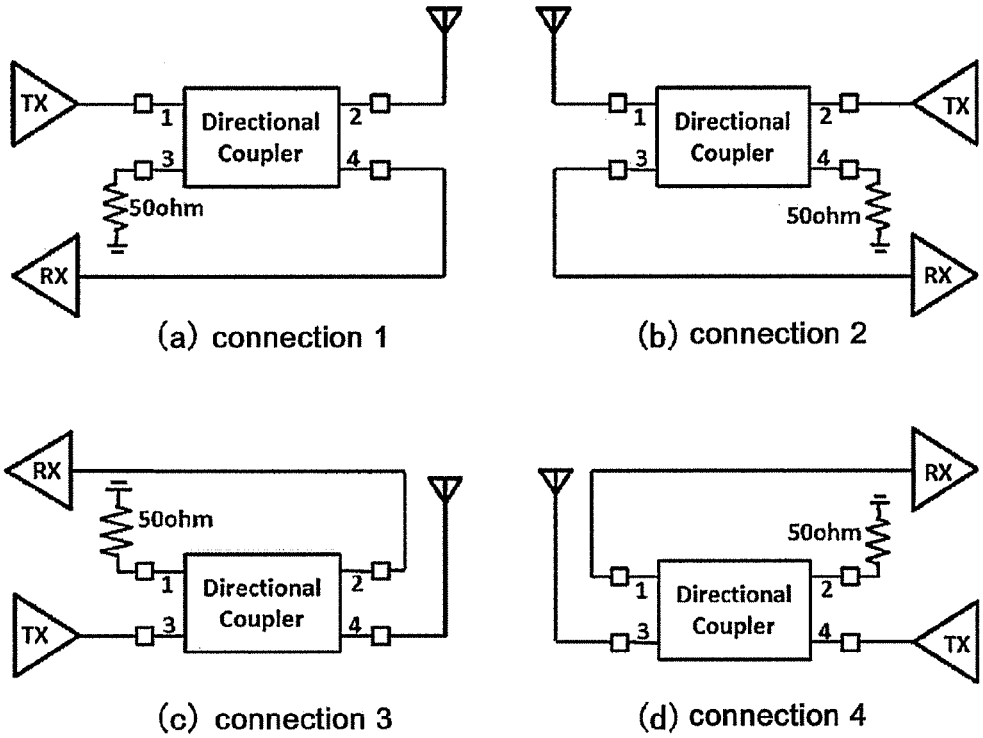
FIG. 6 is a schematic diagram of an embodiment of the present invention.

A terminal 1 in FIG. 6 is an input terminal (Input) of the directional coupler integrated by CMOS process, a terminal 2 in FIG. 6 is a direct terminal (Direct), a terminal 3 in FIG. 6 is an isolated terminal (Isolated), and a terminal 4 in FIG. 6 is a coupled terminal (Coupled).

The directional coupler integrated by CMOS process may be connected as shown in FIG. 6(*a*). The terminal 1 is connected with an output terminal of the transmitter (TX), the terminal 2 is connected to the antenna (Antenna), the terminal 3 is connected to a grounded resistor (Res) of 50 ohm, and the terminal 4 is connected to an input terminal of the receiver (RX). The definitions of respective parameters are as follows: S12 (S21) corresponds to the insertion loss, S24 (S42) corresponds to the coupling degree, and S14 (S41) corresponds to the isolation degree.

The directional coupler integrated by CMOS process may also be connected as shown in FIG. 6(*b*). The terminal 2 is connected with the output terminal of the transmitter (TX), the terminal 1 is connected to the antenna (Antenna), the terminal 4 is connected to the grounded resistor (Res) of 50 ohm, and the terminal 3 is connected to the input terminal of the receiver (RX). The definitions of respective parameters are as follows. S12 (S21) corresponds to the insertion loss, S13 (S31) corresponds to the coupling degree, and S23 (S32) corresponds to the isolation degree.

The directional coupler integrated by CMOS process may also be connected as shown in FIG. 6(*c*). The terminal 3 is connected with the output terminal of the transmitter (TX), the terminal 4 is connected to the antenna (Antenna), the terminal 1 is connected to the grounded resistor (Res) of 50 ohm, and the terminal 2 is connected to the input terminal of the receiver (RX). The definitions of respective parameters are as follows. S34 (S43) corresponds to the insertion loss, S24 (S42) corresponds to the coupling degree, and S23 (S32) corresponds to the isolation degree.

The directional coupler integrated by CMOS process may also be connected as shown in FIG. 6(*d*). The terminal 4 is connected with the output terminal of the transmitter (TX), the terminal 3 is connected to the antenna (Antenna), the terminal 2 is connected to the grounded resistor (Res) of 50 ohm, and the terminal 1 is connected to the input terminal of the receiver (RX). The definitions of respective parameters are as follows. S34 (S43) corresponds to the insertion loss, S31 (S13) corresponds to the coupling degree, and S14 (S41) corresponds to the isolation degree.

A directional coupler technology and integrated circuit based on a standard CMOS process is described through the specific embodiments mentioned above, those skilled in the art of the field may make various changes in terms of forms and contents according to the above steps without departing from the substantial scope protected by the present invention. Thus, the present invention is not limited to the content disclosed in the embodiments.

What is claimed is:

1. A directional coupler based on a CMOS process, comprising:

a first coil which is formed by a Mth metal layer and is connected between an input terminal and a direct terminal, and a first intersect portion of which is connected by (M−1) th metal layer; a second coil which is formed by an Nth metal layer and is connected between a coupled terminal and an isolated terminal, and a second intersect portion of which is connected by (N+1)th metal layer and the first coil and the second coil to form a three-dimensional structure;

wherein the first coil and the second coil are formed in a shape of a square, a circle, a rectangle, an octagon or other polygon;

wherein two ends of the first coil and two ends of the second coil form an angle of 90°, a distance between the direct terminal and the coupled terminal is small while a distance between the input terminal and the coupled terminal is large;

wherein metal lines of the first coil and the second coil are arranged to intersect vertically, a center of an upper layer metal line is vertically aligned with a center of an interval of a lower layer metal line, the upper and lower layer metal lines have an overlap, wherein a line width of the metal lines is larger than or equal to a vertical interval between the metal lines;

wherein a first adjustable capacitor array is disposed between the input terminal and the direct terminal to achieve a frequency tuning; and wherein a second adjustable capacitor array is disposed between the coupled terminal and the isolated terminal to achieve an isolation degree tuning.

2. An integrated circuit used for a directional coupler tuning technology, wherein, the integrated circuit comprises the directional coupler according to claim 1, and the directional coupler changes a frequency of a lower concave point of an isolation degree curve by changing the first adjustable capacitor array, and changes a down concaved depth of the isolation degree curve by changing the second adjustable capacitor array.

3. The integrated circuit of claim 2, wherein, the integrated circuit is fabricated by a BiCMOS process.

4. The integrated circuit of claim 3 wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

5. The integrated circuit of claim 3 wherein the CMOS process is based on a Si substrate.

6. The integrated circuit of claim 5 wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

7. The integrated circuit of claim 2, wherein the integrated circuit is fabricated by a BJT and/or HBT process.

8. The integrated circuit of claim 2, wherein the integrated circuit is integrated on a single chip.

9. The integrated circuit of claim 8 wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

10. The integrated circuit of claim 2, wherein the integrated circuit is a radio frequency identification reader.

11. The directional coupler of claim 1, wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

12. The directional coupler of claim 1, wherein the first adjustable capacitor array prevents deterioration due to one or more non-ideal effects regarding output of the directional coupler including at least one of poor matching between outputs of transmitters associated with the directional coupler, varied output matching under different output powers, process fluctuation, and/or temperature variation.

13. The directional coupler of claim 1, wherein one or more of insertion loss, coupling degree, isolation degree, and/or directivity associated with the directional coupler is adjustable by changing one or more metal lines at different layers or by changing the vertical interval between the upper and the lower metal lines.

14. The directional coupler of claim 13, wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

15. The directional coupler of claim 1, wherein the directional coupler is fabricated by a BiCMOS process.

16. The directional coupler of claim 1, wherein the directional coupler is integrated into a single chip via a silicon-based CMOS or BiCMOS process.

17. The directional coupler of claim 16, wherein the directional coupler has performance parameters, including one or more of coupling degree, isolation degree and/or directivity, which are flexibly changeable as a function of selecting different coil shapes, quantity of coil windings, line widths of the metal lines, quantity of the metal layers and/or quantity of the metal lines overlapped between different metal layers.

18. The directional coupler of claim 16, wherein one or more of insertion loss, coupling degree, isolation degree, and/or directivity associated with the directional coupler is adjustable by changing one or more metal lines at different layers or by changing the vertical interval between the upper metal and the lower metal lines.

19. The directional coupler of claim 16, wherein the first adjustable capacitor array prevents deterioration due to one or more non-ideal effects regarding output of the directional coupler including at least one of poor matching between outputs of transmitters associated with the directional coupler, varied output matching under different output powers, process fluctuation, and/or temperature variation.

20. The directional coupler of claim 1, wherein the directional coupler is fabricated by at least one of a BJT and/or HBT process.

* * * * *